US005081929A

United States Patent [19]

Mertens

[11] Patent Number: 5,081,929

[45] Date of Patent: Jan. 21, 1992

[54] PROJECTILE HAVING A MOVABLE INTERIOR FUZE

[76] Inventor: William J. Mertens, 901 W. 21st St., Connersville, Ind. 47331

[21] Appl. No.: 618,272

[22] Filed: Nov. 19, 1990

Related U.S. Application Data

[63] Continuation-in-part of Ser. No. 421,429, Oct. 12, 1989, abandoned.

[51] Int. Cl.[5] ..... F42C 1/06

[52] U.S. Cl. ..... 102/273; 102/246; 102/248; 102/255

[58] Field of Search ..... 102/272–275, 102/232, 233, 238, 248, 255, 244, 246, 249

[56] References Cited

U.S. PATENT DOCUMENTS

| | | | |
|---|---|---|---|
| 1,321,455 | 11/1919 | Kennedy | 102/273 |
| 1,462,173 | 7/1923 | Haas | 102/273 |
| 1,545,866 | 7/1925 | Van Essen | 102/275 |
| 1,749,720 | 3/1930 | Scaglia | 102/273 |
| 3,105,440 | 10/1963 | Brandt | 102/273 |

*Primary Examiner*—David H. Brown

[57] ABSTRACT

In a fuse arrangement, which can be used in both low velocity and in high velocity gun-launched grenades, which has a rotationally responsive fuse timing mechanism arranged in a fuse casing, The fuse casing being tiltable and axially movable upon impact of the grenade thereby forcing the entire fuse housing toward a fixed firing pin and detonating the grenade.

8 Claims, 5 Drawing Sheets

PROJECTILE HAVING A MOVABLE INTERIOR FUZE

GOVERNMENTAL INTEREST

The U.S. Government has rights in this invention pursuant to Contract No. DAAK-10-80-C-0323 awarded by the Department of the Army, including without limitation, a royalty-free license to make or have made, and to use products made with this invention, according to the conditions thereto.

This application is a continuation-in-part of application Ser. No. 07/421,429, filed Oct. 12, 1989, now abandoned.

FIELD AND BACKGROUND OF THE INVENTION

The invention relates, in general, to gun launched grenades, and, in particular, to a new and useful movable and tiltable fuse arrangement which can be used for a number of different projectile sizes and projectile velocities. The invention provides a fuse with a clock-type mechanism to move a detonator from a safe to an armed position which requires the occurrence of two different physical phenomena.

Clock-type mechanisms to move critical elements of the initiation train, i.e. the detonator, from a safe to an armed position are known. Also known are designs which require the occurrence of a minimum of two different physical phenomenon in order to move the clock-type mechanism so that an explosive warhead must move a minimum specified distance away from the gunner to prevent completion of the initiation train prior to the projectile having travelled the minimum specified distance.

The fused design of the M550 is composed of two separate mechanical assemblies which joined together in the nose of the projectile, provide a means whereby a projectile will travel a safe distance before the detonator is moved to an armed position whereby the warhead can be exploded. The first mechanical assembly is an escapement assembly with an eccentrically rotatably mounted rotor having an eccentric center of mass. The center of mass moves from a factory-positioned first location near a rotational axis of the projectile to a second location being spaced from the rotational axis of the projectile. The rotational movement moves a detonator to a detonating position adjacent a firing pin. The rotor is part of an escapement configuration in which the rotational energy of the rotor is absorbed by a pinion and verge arrangement thereby effecting a timed relationship for the movement of the detonator from the unarmed to the armed position. The timed relationship is dependent upon the number of rotations of the projectile.

The second mechanical assembly includes an actuator assembly in which a number of hammers are pivotally arranged on the forward end of the projectile which, upon sudden deceleration of the projectile, pivot about a pivot point and impact on and force a firing pin rearward into the detonator, provided the detonator is in the armed position.

When the high velocity version of basically the same warhead was begun, it was realized that, theoretically, the same fuse system would work in the high velocity warhead. The high velocity barrel twist rate was not changed, therefore the relationship of the spin rate to the projectile travel remained constant. Theoretically, the same fuse arrangement could be used for the higher velocity warhead. However, the increased set-back force from the increased acceleration, caused the heavy actuator to practically crush the escapement. Further, the greatly increased spin rate would tear the hammers off the actuator by centrifugal force.

Thus, it was desired to use the same escapement system, but another means of initiating the detonator had to be found. The warhead was re-designed to eliminate the actuator assembly and a firing pin was arranged fixed at the forward end of the warhead pointing rearwardly. The detonator-rotor component of the escapement was allowed to slide forward thereby driving the detonator into the fixed firing pin.

Unfortunately, it was found that the detonator-rotor component of the escapement would have to be increased in weight. The increased rotor weight necessitated changes in other components of the escapement as well. Today, there are no common items of any significance between the low velocity warhead and the high velocity warhead fuses, except that they operate with the same off-center center of mass rotor concept.

The heavier escapement mechanism for the high velocity projectile utilizes a journal for the rotor having a first end affixed to a forward end of the projectile body. An opposite second end of the rotor journal is fixed to a rearward end of the projectile body. Similarly, the energy-absorbing pinion gear rotates about a journal which is fixed at a first end to the forward end of the projectile body, and is fixed at an opposite end to the rearward end of the projectile body. Upon impact, the rotor and the detonator are allowed to slide along the length of the rotor journal and the pinion journal to engage the detonator with the firing pin.

Also disadvantageous is that the high velocity fuse configuration proved to be too bulky and inoperative when used in the low velocity warhead.

SUMMARY OF THE INVENTION

The invention provides a fuse configuration which can be used in both high velocity and the low velocity warheads. The firing pin is held fixed at a forward end of the fuse configuration and projects rearward toward the escapement assembly. Upon impact, the entire mass of the escapement configuration is allowed to slide forward, or to tilt forward, or a combination of both bringing the detonator into contact with the firing pin, thereby exploding the warhead.

The invention provides a rotatable missile comprising a missile body having a space therein. A firing pin is arranged at a forward end of the space projecting rearwardly. A detonator is arranged at a rearward end of the space and is movable along a path from a first position out of alignment with the firing pin to a second position into alignment with the firing pin. The movement of the detonator along the path is effected by the rotation of the missile body. The detonator is then movable toward the firing pin upon a rapid deceleration of the missile body.

The detonator is assembled in a brass body arranged around a pivot axis which is off center with respect to the projectile rotational axis. The center of mass of the body is off axial center with respect to the rotor rotational axis, and is located in-board in an unarmed position, or factory assembled position. The outer portion, or periphery, of the brass body has gear teeth which are engageable with a pinion such that the pinion must rotate whenever the brass body rotates. A weight called a verge is engaged with the pinion such that it must oscillate as the pinion rotates. Rotational energy applied to the brass body, therefore, is absorbed by the oscillation of the verge. All three parts are held in place by individual axles secured between a rearward plastic housing and a forward aluminum top plate of the escapement assembly.

In the safe, or unarmed position, the brass body is advantageously secured by two separate components: a detent and a set-back pin. The set-back pin physically blocks rotation of the rotor by extending into the escapement. A set-back pin is advantageously biased by, for example, a one-way leaf spring requiring a minimum of force to allow the pin to move rearward. Thus, unless the projectile is accelerated in a manner provided only by proper gun firing, the set-back pin maintains its position and the rotor is unable to rotate.

The rotor is also advantageously locked by a detent which is, for example, engaged with the gear teeth of the rotor. The detent is advantageously biased radially inward toward the gear teeth. The mass of the detent is such that the projectile must rotate at least a minimum r.p.m. before centrifugal force on the detent is sufficient to overcome the biasing force.

Thus, two separate locks must be subjected to different forces that will occur only when the projectile is properly launched, thereby providing two different physical phenomena to arm the fuse.

Centrifugal force on the center of mass of the rotor produces a torque on the rotor in direct proportion to the projectile spin rate. Restricted to rotation about the rotor pivot axis, the movement of the center of mass from inboard to outboard position rotates the rotor and consequently the pinion gear. The total path of rotation can advantageously be substantially equal to 100°.

In the unarmed position, the detonator is in an outboard location which, upon rotation of the rotor, moves to an inboard location into alignment with the firing pin. The rotor is held with the center of mass in the outboard position by the continued rotation of the projectile.

The rotation of the rotor and the engaged pinion gear produces an expenditure of energy through oscillation of the verge. Thus, time is expended while the rotor rotates. This expenditure of time allows the projectile to travel a specified distance from the launcher, thereby providing a required safe separation distance before the warhead can be initiated.

As indicated, the entire escapement configuration or fuse housing moves forward or tilts forward upon impact of the projectile. Sufficient force is provided by the movable fuse housing which is configured to include substantially all the supportive mechanisms of the escapement thereby providing enough mass "behind" the fuse to force the detonator into the firing pin.

Impact with various targets by the tilting body fuse causes different reactions as follows:

1. If the projectile impacts on oblique armor, the ogive presenting its most rigid side to the target, crushes inward driving the firing pin into the detonator. Simultaneously, the escapement is free to slide forward, thereby reducing overall fuse time. This effectively speeds up initiation of the warhead creating greater stand-off for improved shape charge penetration.

2. If the target is a hard vertical armor, the escapement is thrown forward to cause penetration of the detonator by the firing pin. In the case of higher velocity impact, it is most likely that the ogive crush-up will occur first. This will simply reduce fuse reaction time still further since the firing pin is driven rearward while the detonator moves forward.

3. If the warhead experiences low graze impact (no ogive distortion), a rapid deceleration of the projectile will cause the escapement to move forward. If graze impact is sufficient to actually turn the projectile in a ricochet, then gyroscopic action of the escapement occurs simultaneously with its forward motion, again reducing fuse reaction time.

4. If the projectile impacts against a soft target, such as snow, the rapid deceleration will cause detonation.

Accordingly, it is an object of the invention to provide a fuse housing which is movable and tiltable inside a cavity of a projectile which can be used for low velocity-high explosive, low-velocity-improved visibility training, low velocity-special purpose, high velocity-high explosive, high velocity-dual-purpose, and high velocity-improved visibility training projectiles.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENTS

Figure 1:
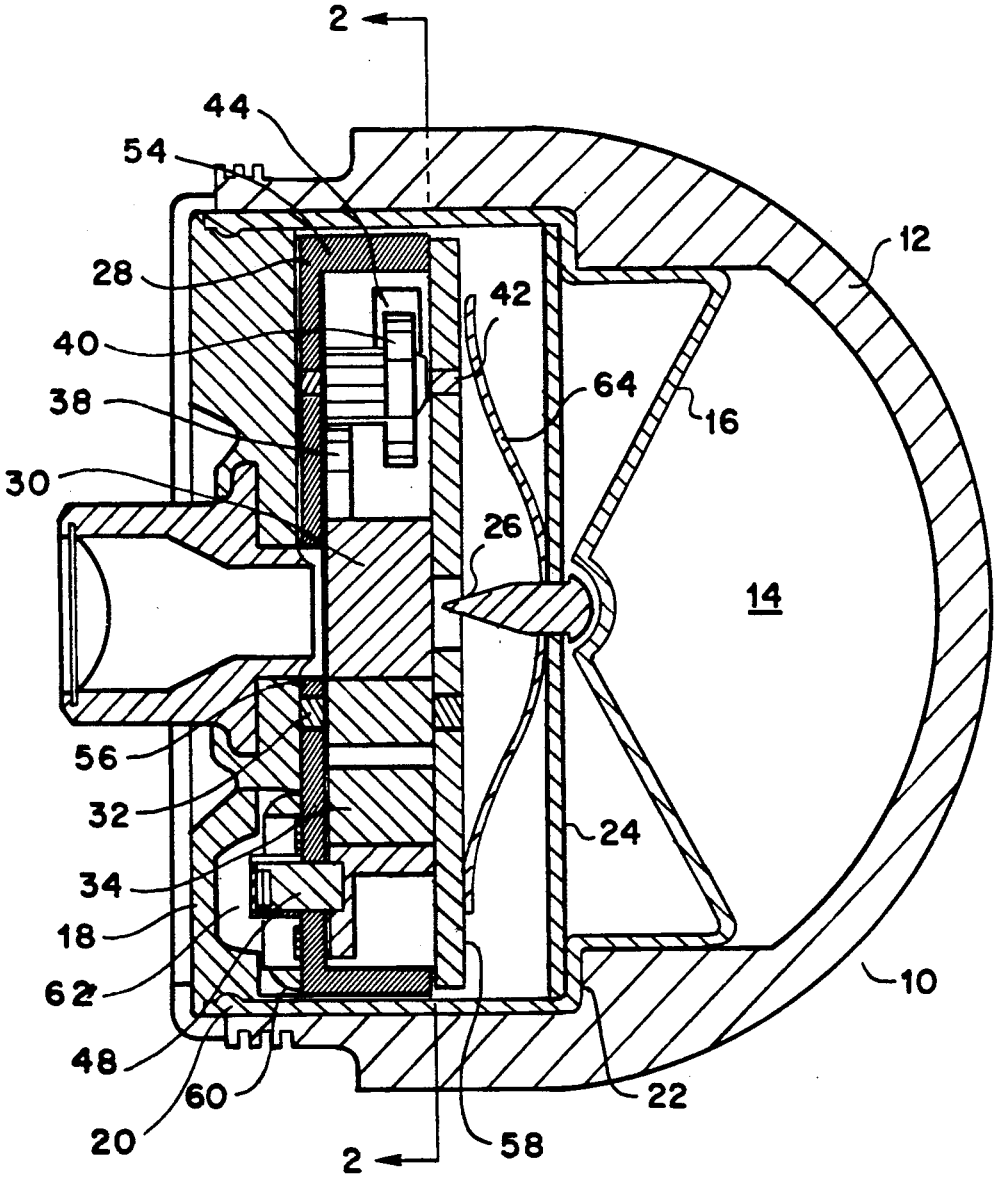
FIG. 1 is a longitudinal cross-sectional view of the fuse arrangement according to the invention.

Referring now to the drawings, in particular, the invention embodied therein, FIG. 1 shows a projectile generally designated 10, having a forward shell or ogive 12 encasing a fuse space 14. Located inside the fuse space is an actuator cup 16 fixed to a bottom plate 18 by a crimping 20 of the actuator cup 16. The ogive 12 has an annular shoulder 22 which the actuator cup 16 conforms to. An end wall 24 sits securely against the actuator cup 16 and the annular shoulder 22. Attached near the center of the end wall 24 is a firing pin 26 extending rearwardly toward an escapement mechanism generally designated 28.

Figure 2:
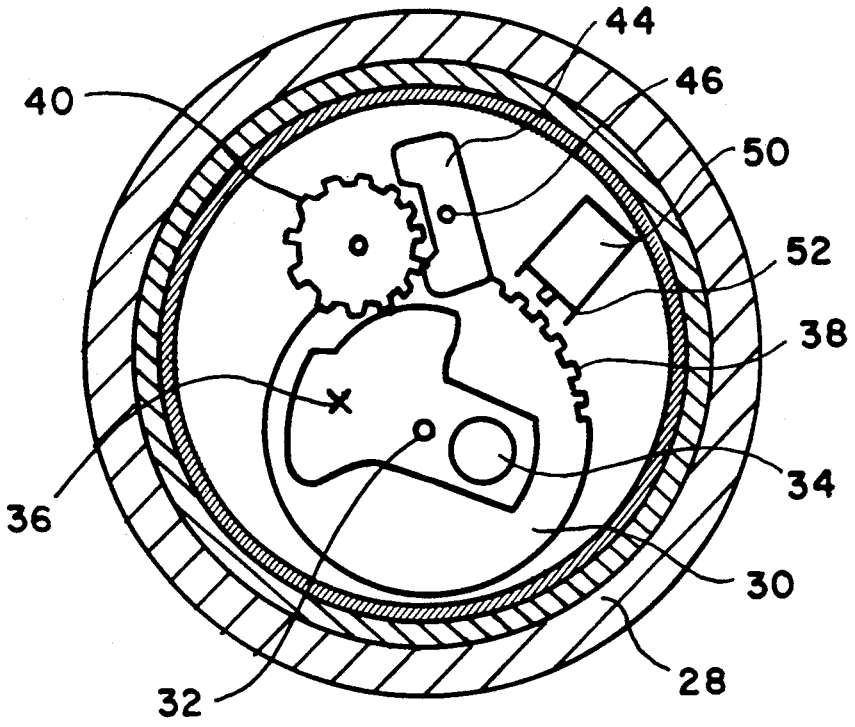
FIG. 2 is a cross-sectional view showing the escapement arrangement taken along the line II—II of FIG. 1.

The escapement mechanism 28 shown in FIGS. 1 and 2 includes a rotor 30 rotatably eccentrically mounted on a pivot axle 32. Embedded into the rotor is a detonator 34 radially spaced from the pivot axle 32. Also radially spaced from the pivot point is the rotor center of mass 36, shown in FIG. 2 as an x in an inboard position. As the projectile rotates, the centrifugal force causes the center of mass 36 to move from the inboard position to an outboard position (not shown), and consequently causes the detonator 34 to rotate about the pivot point 32 to an armed position adjacent the firing pin 26.

The rotor has exterior teeth 38 arranged at a circumferential edge. Engaged with the gear teeth 38 is a pinion 40. The pinion is rotatably mounted on a pinion journal 42.

A verge 44 is arranged adjacent the pinion 40 and is allowed to oscillate back and forth about a verge pivot point 46 as the projectile rotates and the center mass 36 of the rotor 30 moves to an outboard position, the pinion gear 40 is caused to rotate and the rotational energy is absorbed by the oscillating movement of the verge 44, thereby slowing the rotational movement of the rotor 30.

A set-back pin lock means 48 prevents the rotor from rotating by engaging a rearward side of the rotor. Also shown is a detent lock means 50 engaged with the gear teeth 38 of the rotor 30.

The set-back pin 48 becomes disengaged with the rotor upon an axial acceleration of the projectile.

The detent lock is arranged in a detent sleeve 52 to slide radially outward away from the rotor teeth 38. The detent being of sufficient mass to be forced radially outward by the rotation of the projectile 10.

The escapement includes a plastic housing 54 with a rear wall 56 and an aluminum top plate 58 attached to the housing 54. The rotor pivoting axle 32, and the pinion journal 42 project from the housing rear wall to the top plate.

The set-back pin 48 includes a set-back pin housing 60 arranged on the rear wall 56. The bottom plate 18 includes a bottom plate recess 62 which receives the set-back pin housing 60, thereby securing the escapement housing 54 from rotating relative to the projectile 10.

In the embodiment according to FIG. 1, an anti-creep spring 64 is arranged to keep the escapement mechanism in a rearward position and away from the firing pin 26.

Figure 3:
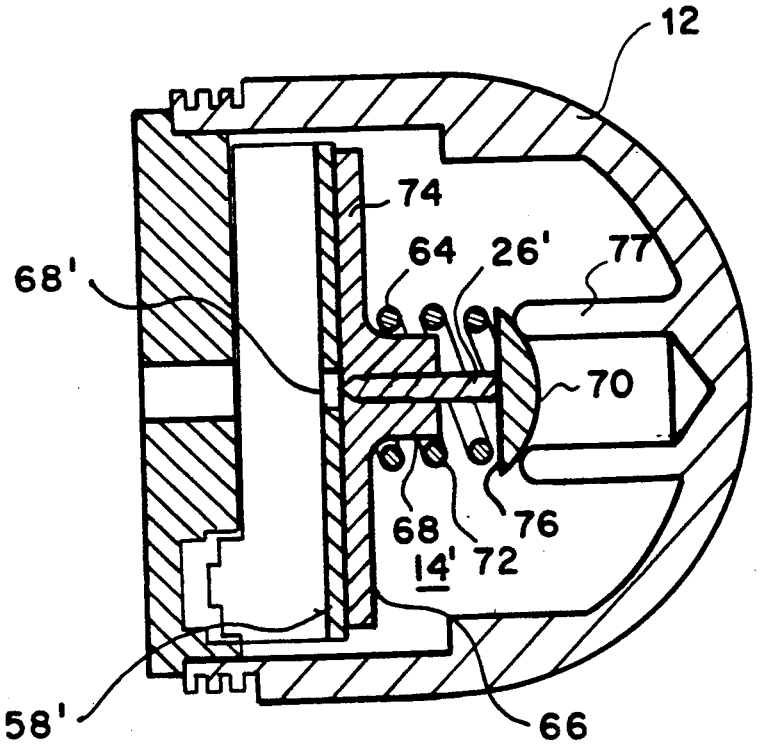
FIG. 3 is a longitudinal cross-sectional view of a second embodiment according to the invention.

FIG. 3 shows a second embodiment of the invention in which a top plate 58' is attached to a positioning sleeve 64 having a securing flange 66. The positioning sleeve 64 and the top plate 58' each define co-axial recesses 68 and 68' therein. The co-axial recesses 68 and 68' receive a firing pin 26' having an engagement cap 70 attached to a forward end.

Arranged co-axial with the firing pin 26' is a coil spring 72. One end of the coil spring 72 engages with a forward surface of the securing flange 66. A second opposite end of the coil spring 72 engages on a rearward surface 76 of the engagement cap 70. The engagement cap 70 rests on an annular seat 77 which projects from the ogive 20 into the fuse space 14'.

Figure 4:
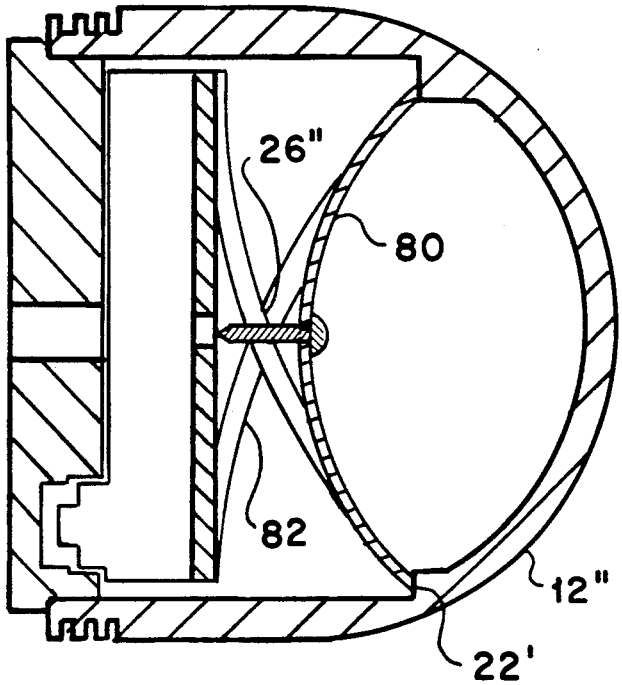
FIG. 4 is a cross-sectional longitudinal view of a third embodiment according to the invention.

A third embodiment is shown in FIG. 4, in which the firing pin 26'' is held in place by a cup 80 which is concave at a forward side, and which rests on an annular shoulder 22' of the ogive 12''. Arranged between the convex side of the cup 80 and the escapement is a leaf spring 82 which holds the escapement mechanism rearward while holding the firing pin 26'' forward.

Figure 5:
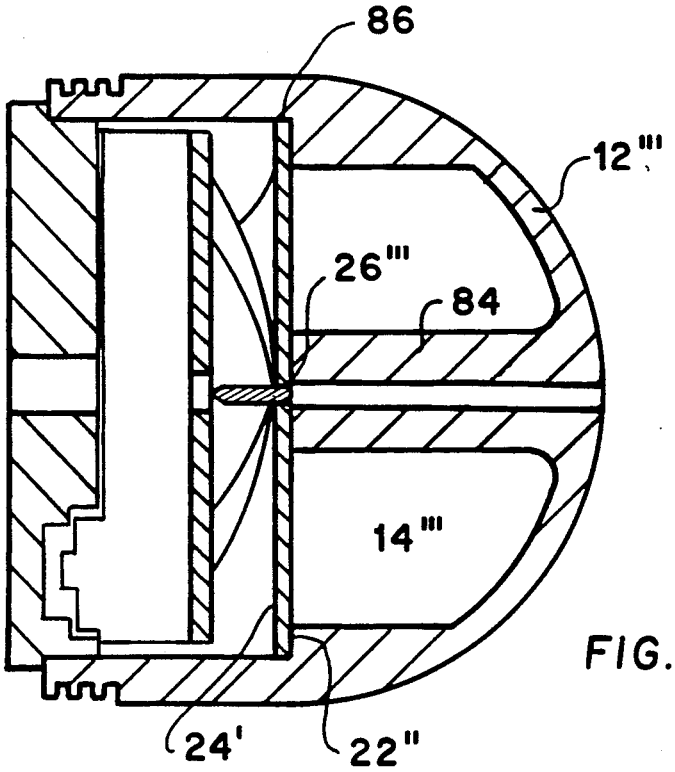
FIG. 5 is a longitudinal cross-sectional view of a fourth embodiment according to the invention.

FIG. 5 shows a further arrangement for holding the firing pin 26'''. Attached to the inside surface of the ogive 12''' and projecting inwardly into the fuse space 14''' is a seat member 84. Resting on the seat 84 and on the annular shoulder 22'' is an end wall 24'. The firing pin 26''' is attached to the end wall 24' and projects rearwardly toward the escapement. Biasing the escapement toward a rearward position are leaf springs 86.

All the embodiments shown and described function similarly. When the projectile is launched from the gun barrel, the set-back pin 48 moves rearward from its rotor locking position at the base of the escapement. Rotational acceleration of the projectile is transferred to the escapement through the set-back pin housing of the escapement. Upon exit from the launch tube, the spring means provided between the escapement and the firing pin hold the escapement rearward and hold the firing pin forward insuring that the firing pin does not engage with the rotor. The spring means in each embodiment provides a spring force that is larger than the set forward force on the escapement produced by aerodynamic drag on the projectile.

Provided a minimum r.p.m. of the projectile has been attained during barrel acceleration, the detent within the escapement moves radially outward and the rotor is then free to align the detonator with the firing pin.

Figure 6:
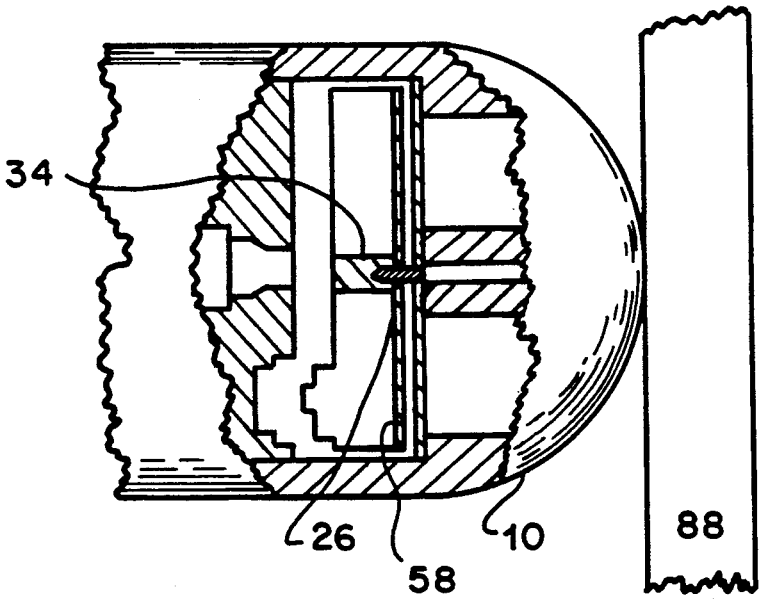
FIG. 6 shows a projectile impacting on the vertical target with the entire escapement arrangement according to FIGS. 1, 2, 3, 4, and 5 sliding forward to engage a detonator with a fixed firing pin with means biasing the escapement away from the pin omitted for clarity.

FIG. 6 shows a projectile 10 impacting upon a vertical target 88 from a direction which is normal to the target surface. The entire escapement configuration 58 is shifted forward toward firing pin 26 against a biasing means (omitted in FIGS. 6 and 7 for clarity). The entire mass of the escapement configuration providing force to impact the detonator 34 onto firing pin 26.

Figure 7:
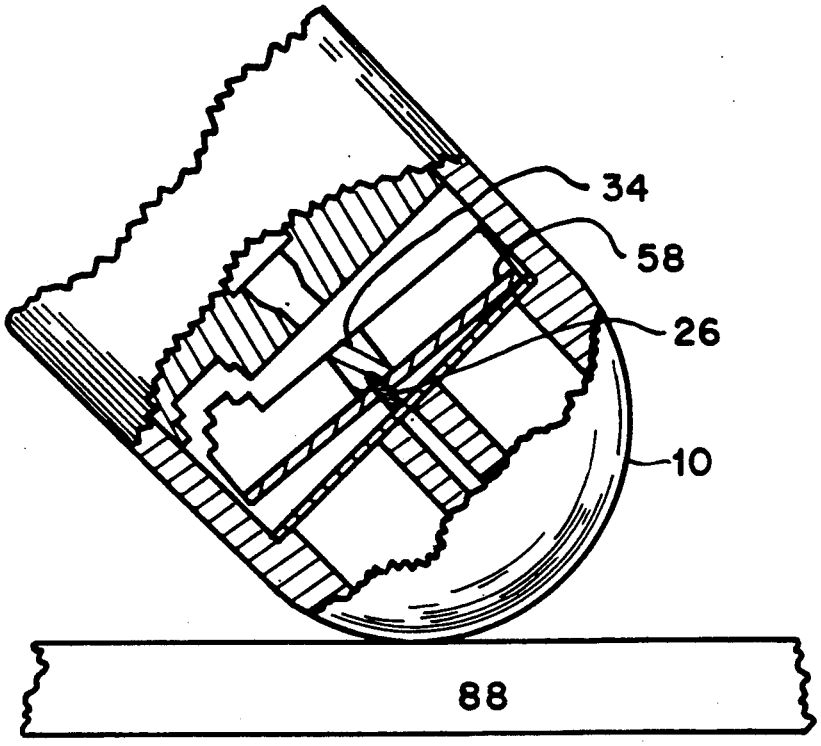
FIG. 7 shows the projectile impacting on an oblique target according to FIGS. 1, 2, 3, 4, and 5 with the entire escapement arrangement tilting and sliding forward with means biasing the escapement away from the pin omitted for clarity.

FIG. 7 shows a projectile 10 impacting on a target 88' from a direction which is askew to the target surface. The entire configuration 58 tilts and moves forward, impacting the detonator 34 on the firing pin 26.

Figure 8:
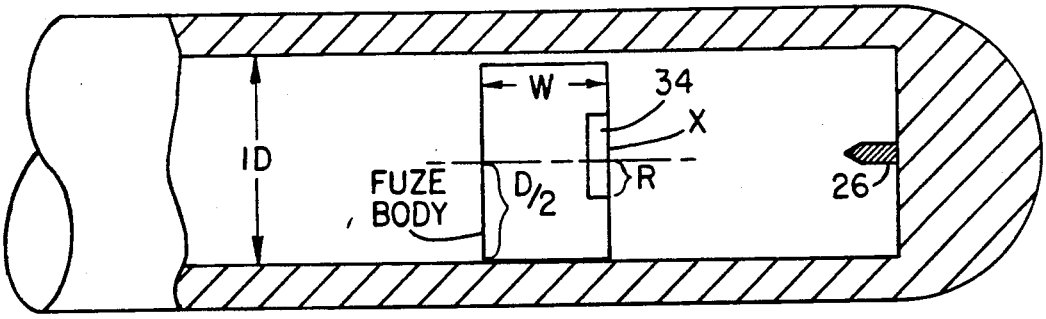
FIG. 8 shows a sectional view of the fuse body at rest.

FIG. 8 shows an exaggerated view of the fuze body, hypothetically flat at rest within the projectile. The fuze body diameter (its height here in this crossectional side view), is given by D. This diameter is slightly smaller than the inside diameter of the projectile (ID), shown greatly exaggerated here, to allow the fuze body to slide. Whenever the detonator in central region 34 contacts pin 26, there can be a detonation. Ideally, the pin should contact within the central $\frac{1}{3}$ face area of the said region 34. Striking at an angle, when the body is tilted as it slides towards the pin (such as in FIG. 9), will still cause a detonation in the same way, if the same face area is contacted, notwithstanding the angular striking. The center line for the fuze body lies below the projectile's center line, it is noted here, by a small distance (where the center lines hit the face), when the system is at rest in the manner shown in FIG. 9. Obviously X must be less than or equal to the radius, R, of central detonation region 34, or else there will be no detonation; i.e., the pin will not be able to contact within the face area of 34 at all. Further, it should best contact within the inner $\frac{1}{3}$ face area of region 34. The radius of such inner $\frac{1}{3}$ area, would be $R/\sqrt{3}$. Thus X must be within the range of $R-(R/\sqrt{3})$, or 0.423 R. For the pin to contact the inner $\frac{1}{3}$ area then, one has that, the fuze body diameter must be such that $D \geqq ID - 0.423\ R$ (Equation 1).

Figure 9:
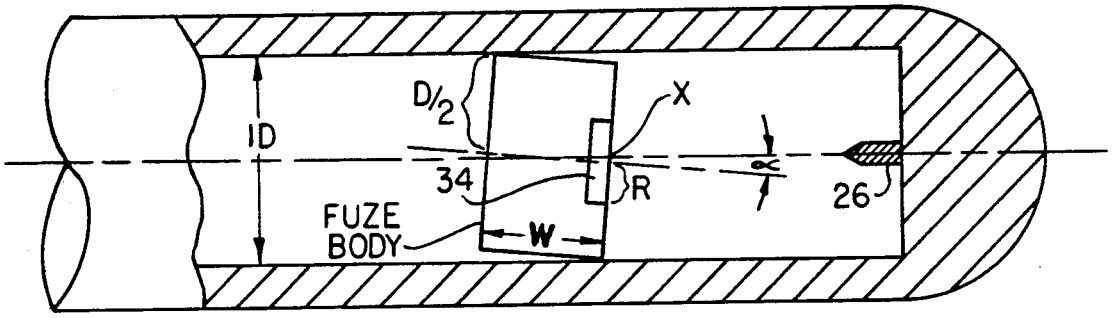
FIG. 9 shows a sectional view of the fuse body tilted at an angle $\alpha$ to the resting axis.

FIG. 9 shows (another) exaggerated view of the fuze body when tilted to an angle, $\alpha$, off the perpendicular resting position of FIG. 8. Even if pin 26 contacts central region 34 at an angle (here, $\alpha$), there can still be a detonation. The contact is (basically) all that is needed. It is noted that $\alpha$ cannot be greater than 45° or else the fuze body can rotate past its corners as it tilts, and tip over. The fuze then could not operate. Therefore one upper limit is given for $\alpha$, that is $-45° < \alpha < 45°$. Ideally, one would expect the tilt angle to be: $-5° < \alpha < 5°$. (Equation 2) By reference to FIG. 10, (as explained below), one can determine a general trignometric relationship between W, D and $\alpha$, for a given ID, being: $W \sin \alpha + D \cos \alpha = ID$ (Equation 3). By using the design constraints of Equation 1 and (whatever angle selected) of Equation 2, substituted into Equation 3, one can help define the necessary fuze body dimensioning for a particular projectile.

Figure 10:
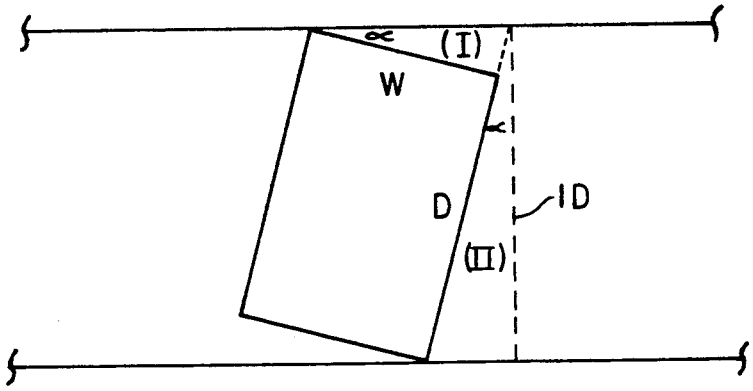
FIG. 10 shows the relationship of the tilt angles.

In FIG. 10 one can see that: in triangle (I), the dashed side is equal to W Tan $\alpha$. In triangle (II), the hypotenuse is equal to (W Tan $\alpha$+D). It can also be seen that $\cos \alpha = ID/(W\text{Tan } \alpha + D)$. When reduced, this becomes $W \sin \alpha + D \cos \alpha = ID$ (Equation 3), when the fuze body is tilted at rest in the manner and in the simplified rectangular shape shown in FIGS. 9 and 10.

While specific embodiments of the invention have been shown and described in detail to illustrate application of the principles of this invention, it will be understood that the invention may be embodied otherwise without departing from such principles.

What is claimed is:

1. A fuze for a projectile, wherein said projectile comprises essentially a tube-like structure having a defined central longitudinal axis, a defined inside diameter, ID, a defined aft-end of said projectile, a defined nose-end of said projectile which is essentially capped and which also holds a fuze activating pin means inside said projectile joined to the nose-end so that said pin means is held essentially along said longitudinal axis and facing in the direction of said aft-end, said fuze comprising a planar, disc-like fuze body having a defined diameter, D, a defined thickness, W, and defined opposite flat faces each face circular shaped with a defined center point, surrounded on one of said faces by a defined concentric central region having a defined central region radius, R, and whereby the said fuze body is normally positioned by spring means within said projectile to be essentially plane perpendicular to said projectile longitudinal axis, the fuze body diameter being smaller relative to said projectile inside diameter, sufficient to permit free sliding of said fuze body inside the projectile in the direction towards said nose-end, and whereby the face having said central region faces in the said nose-end direction, and whereby the center of said face is always less than a distance, X, from said longitudinal axis, where $X \leqq R/\sqrt{3}$ and whereby the parameters of fuze body thickness, fuze body diameter, and of said projectile inside diameter are so related that the said fuze body is capable when sufficient force is applied to urge said spring means, of tilting inside said projectile at an angle, $\alpha$, up to ±45° off the normal position where the fuze body would be essentially plane perpendicular to the said projectile longitudinal axis, and whereby said fuze is so arranged that it will detonate when the central region of the face in the direction of the nose-end, comes into contact with said pin means, whereby upon a projectile impact when said fuze body by inertia of motion slams into said pin means, contacting same with said central region, such contract will thereby lead to a fuze detonation.

2. The fuze of claim 1 whereby D is selected by $D \geqq ID - 0.423\ R$, where R and ID are known.

3. The fuze of claim 1 whereby W is given by solution of the equation $W \sin \alpha + D \cos \alpha = ID$ for a given $\alpha$, D and ID.

4. The fuze of claim 1 whereby said angle, $\alpha$, is ±40°.

5. The fuze of claim 1 whereby said angle, $\alpha$, is ±30°.

6. The fuze of claim 1 whereby said angle, $\alpha$, is ±20°.

7. The fuze of claim 1 whereby said angle, $\alpha$, is ±10°.

8. The fuze of claim 1 whereby said angle, $\alpha$, is ±5°.

* * * * *